United States Patent [19]

Agarwal

[11] Patent Number: 4,464,720

[45] Date of Patent: Aug. 7, 1984

[54] CENTRIFUGAL COMPRESSOR SURGE CONTROL SYSTEM

[75] Inventor: Suresh C. Agarwal, Euclid, Ohio

[73] Assignee: The Babcock & Wilcox Company, New Orleans, La.

[21] Appl. No.: 348,620

[22] Filed: Feb. 12, 1982

[51] Int. Cl.[3] ..... F04D 27/02

[52] U.S. Cl. ..... 364/431.02; 415/1; 415/11; 415/17; 364/494

[58] Field of Search ..... 364/431.02, 494; 415/11, 26, 28, 39, 49, 1, 17, 27

[56] References Cited

U.S. PATENT DOCUMENTS 3,292,845 12/1966 Hens et al. ..... 415/11
3,292,846 12/1966 Harper et al. ..... 415/1
4,156,578 5/1979 Agar et al. ..... 415/1
4,164,034 8/1979 Glennon et al. ..... 364/431.02
4,203,701 5/1980 Abbey ..... 415/11
4,230,437 10/1980 Bellinger et al. ..... 415/11

*Primary Examiner*—Jerry Smith
*Assistant Examiner*—Karl Huang
*Attorney, Agent, or Firm*—Vytas R. Matas; Robert J. Edwards

[57] ABSTRACT

A surge control system is disclosed for centrifugal compressors which utilizes an algorithm to calculate a desired orifice differential pressure and compare the calculated result with an actual differential pressure. A controller is provided for operating a blow-off valve to bring the actual differential pressure to the calculated differential pressure.

9 Claims, 5 Drawing Figures

CENTRIFUGAL COMPRESSOR SURGE CONTROL SYSTEM

FIELD AND BACKGROUND OF THE INVENTION

The present invention relates, in general, to surge control systems and, in particular, to a new and useful method and apparatus for controlling surge in a centrifugal compressor.

The centrifugal compressor is one of the most commonly used means of gas compression. It is used in many fields, such as the petroleum, chemical and synthetic fuel industries.

It is known that the operation of a centrifugal compressor can become unstable due to changes in various operating conditions such as flow rate or pressure. This causes rapid pulsations in flow which is called surge.

When operated into the surge region, the head flow characteristics of a centrifugal compressor actually reverse slope developing a negative resistance characteristic as shown in the characteristic curves of FIG. 1. As flow is reduced, discharge pressure falls, so that flow and pressure are further reduced. When discharge pressure falls below that in the surge line 10, a momentary reversal of flow occurs and line pressure starts to fall. This condition creates demand for more flow causing flow to reverse again. This pulsation continues until either a control action is applied to force the compressor out of the surge region or until compressor linings or other structures are damaged.

In the current state of the art, surge control systems are based upon differential pressure measurement across an orifice plate which is installed in the compressor suction line. See, for example, *Compressor Handbook for the Hydrocarbon Industries*, Gulf Publishing Co., Houston, Tex., (1979). In many installations, however, such as gas recovery-compressors in a fluid catalytic cracking unit, it is not possible to measure the orifice differential pressure in the compressor suction line due to difficulties in installation. (See the compressor Handbook referred to above).

SUMMARY OF THE INVENTION

An object of the present invention is to provide for the surge control of a centrifugal compressor utilizing a calculation for the orifice differential pressure at the discharge end of the compressor. The orifice differential pressure is calculated using one of suction and discharge pressure alone or these pressures in addition to measured values of suction and discharge temperature. For low compression ratios, the simplifications can be made in the calculation to further simplify the apparatus and method of controlling the centrifugal compressor.

According to the invention, the calculated desired orifice differential pressure is compared with an actual orifice differential pressure and the error amount is used to control a blow-off valve to maintain the operation of the centrifugal compressor above its surge line.

Another object of the invention is to provide a system and method of compressor surge control which provides accurate control over a full range of variable speed and fixed speed compressors which have small or large compression ratios.

A still further object of the invention is to provide for such a control wherein the flow through a compressor is maintained at or slightly above the surge line even though process demand may be at or below this level.

Another object of this invention is to provide apparatus for achieving the foregoing purposes which is simple in design, rugged in construction and economical to manufacture.

While specific embodiments of the invention have been shown and described in detail to illustrate the application of the principles of the invention, it will be understood that the invention may be embodied otherwise without departing from such principles.

DESCRIPTION OF THE PREFERRED EMBODIMENTS

Figure 1:
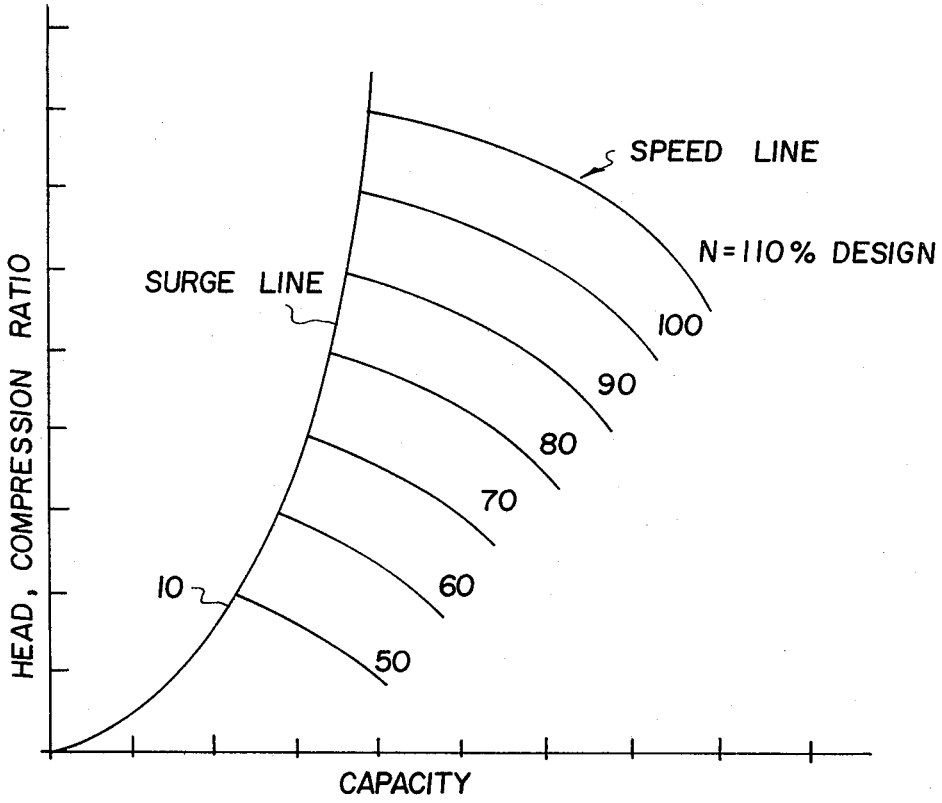
FIG. 1 is a characteristic curve showing a surge line of a centrifugal compressor.

Referring to the drawings in particular, the invention embodied therein, in FIGS. 2 through 5, provides for the surge control of centrifugal compressors using a suction and discharge pressure value with or without suction and discharge temperature values to calculate a desired suction or discharge orifice differential pressure and adjust a valve to regulate an actual differential pressure so that it corresponds to the calculated differential pressure.

Since the gas is compressed adiabatically and isoentropically in a centrifugal compressor:

$$\left(\frac{P_d}{P_s}\right) = \left(\frac{V_s}{V_d}\right)^k \tag{1}$$

where;

$P_d$=Discharge pressure $P_s$=Suction pressure $V_d$=Gas volume at discharge $V_s$=Gas volume at suction $k=C_p/C_v$ $C_p$=Specific heat of gas at constant pressure $C_v$=Specific heat of gas at constant volume.

With W representing the power applied to a compressor and F being the mass flow of gas, and since essentially all of the power introduced into a compressor is converted into an increase in enthalpy of gas, regardless of the irreversibility of the operation, it is true that:

$$-W = \Delta H = F \int_{T_s}^{T_d} C_p dT$$

where:

$\Delta H$=Change in enthalpy of gas due to compression $T_d$=Discharge temperature of gas $T_s$=Suction temperature of gas The power applied to the centrifugal compressor (W) is also related to mass flow of the gas and adiabatic head $h_a$, by the expression:

$$-W=Fh_a/n_a \quad (3)$$

where:

$h_a$=adiabatic head, a parameter commonly used by compressor manufacturers $n_a$=compressor efficiency (adiabatic)

From equations (2) and (3) above, and with F expressed in lbs/min. and head $h_a$ in feet, power W is presented in ft-lbs per minute, and from the conversion factor of 778.3 ft-lb/BUT, we have:

$$h_a = 778.3\, n_a \int_{T_s}^{T_d} C_p dT \quad (4)$$

or:

$$h_a=778.3 n_a Cp(T_d-T_s) \quad (4a)$$

Assuming that:

(1) specific heat of gas is constant with temperature, (2) adiabatic compressor efficiency, $n_a=1$ and (3) w is the molecular weight of gas, then from equation (4a) and from the relationship:

$$C_p-C_v=1{,}987 \text{ Btu/lb mol.} \quad (5)$$

and:

$$\frac{P_s V_s}{T_s} = \frac{P_d V_d}{T_d} \quad (6)$$

and dividing by molecular weight to convert lb mol. units to lbs. we have:

$$h_a = \frac{1546}{mw} T_s \left[ \left( \frac{P_d}{P_s} \right)^m - 1 \right] \quad (7)$$

where:

$$m = \left(1 - \frac{1}{k}\right)$$

In the article "Surge Control for Centrifugal Compressors", *Chemical Engineering*, M. H. White, Dec. 25, 1972, it is observed that surge line appears as a parabola when adiabatic head is plotted against volumetric suction flow, $V_s$, at standard conditions: that is:

$$h_a=K_1 V_s^2 \quad (8)$$

where $K_1$=a constant.

However, in practice, volumetric suction flow ($V_s$) is measured as orifice differential since it cannot be easily measured directly. Moreover, suction and discharge flows are equal at standard conditions, that is:

$$V_s = K_2 \sqrt{\frac{h_d T_d}{P_d w}} \quad (9)$$

where:

$K_2$=orifice meter constant $h_d$=orifice differential measurement in compressor discharge line.

From equations (8) and (9), we have $$h_d = K_1 K_2^2 \frac{h_d T_d}{P_d w} \quad (10)$$

From equations (7) and (10), we have:

$$\frac{1546}{mw} T_s \left[ \left( \frac{P_d}{P_s} \right)^m - 1 \right] = K_1 K_2^2 \frac{h_d T_d}{P_d w}$$

or;

$$h_d = \frac{1546}{K_1 K_2^2} \left( \frac{T_s}{T_d} \right) \left( \frac{P_d}{m} \right) \left[ \left( \frac{P_d}{P_s} \right)^m - 1 \right]$$

or;

$$h_d = K \left( \frac{T_s}{T_d} \right) \left( \frac{P_d}{m} \right) \left[ \left( \frac{P_d}{P_s} \right)^m - 1 \right] \quad (11)$$

where;

$$K = \frac{1546}{K_1 K_2^2} \quad (12)$$

On eliminating suction and discharge temperature terms in equation (11) with the assistance of equations (1) and (6), we have $$h_d = K \left( \frac{P_d}{m} \right) \left( \frac{P_d}{P_s} \right)^m \left[ \left( \frac{P_d}{P_s} \right)^m - 1 \right] \quad (13)$$

Equations (11) and (13) can be further simplified in the following manner:

The relationship between $h_d$ and $(P_d/P_s)^m$ will be linear at m equal to one, however, this is far from reality. Consequently, there is substantial departure from linearity for all but lower compression ratios. Departure from linearity increases with increasing compression ratio. Departure from linearity increases from about 9% at compression ratio 3 to about 25% at ratio 50.

For low compression ratios (below 3) the relationship between $h_d$ and $(P_d/P_s)^m$ is linear, and its slope is given by:

$$\frac{d\,(P_d/P_s)^m}{d\,(P_d/P_s)} = m \left( \frac{P_d}{P_s} \right)^{m-1} \quad (14)$$

at $(P_d/P_s)=1$, we have:

$$\frac{d\,(P_d/P_s)^m}{d\,(P_d/P_s)} = 1 \tag{15}$$

Therefor, $$\left(\frac{P_d}{P_s}\right)^m - 1 \simeq m\left(\frac{P_d}{P_s} - 1\right) \tag{16}$$

Now from equations (11) and (16), we have:

$$h_d = K\left(\frac{T_s}{T_d}\right)(P_d)\left(\frac{P_d}{P_s} - 1\right) \tag{11a}$$

and from equations (13) and (16), we have:

$$h_d = K\left(\frac{P_d}{m}\right)^m\left(\frac{P_d}{P_s} - 1\right)\left[1 + m\left(\frac{P_d}{P_s}\right)\right]$$

or;

$$h_d = K\,(P_d)\left(\frac{P_d}{P_s} - 1\right)\left[1 + m\left(\frac{P_d}{P_s}\right)\right] \tag{13a}$$

Equations (11), (11a), (13) and (13a) give the calculated orifice differential pressure in a centrifugal compressor discharge line.

A set point value of a valve controller can be adjusted to hold the orifice differential pressure ($h_d$) as measured, equal to the calculated value of equations (11), (11a), (13) and (13a).

In many installations, it is not possible to measure the orifice differential pressure in the compressor suction line, hence the orifice differential pressure in the discharge line is used per equation (13).

Figure 2:
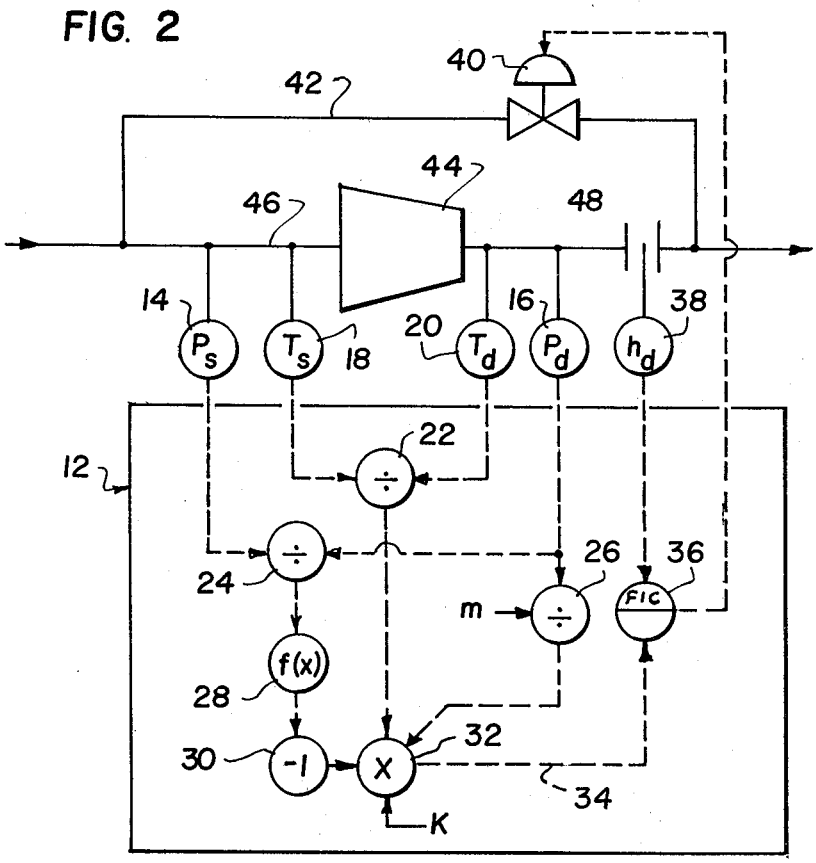
FIG. 2 is a schematic block diagram of an apparatus used in accordance with the invention wherein suction pressure and temperature values as well as discharge temperature and pressure values are utilized to calculate a desired orifice differential pressure at the discharge side.

Referring now to the drawings specifically, the invention, as shown in FIG. 2 provides apparatus for achieving the calculation of equation (11) in the form of a control unit generally designated 12. As with the other embodiments of the invention, control can be achieved using for example the 7,000 ELECTRONIC ANALOG INSTRUMENTATION of Bailey Controls, Division of The Babcock & Wilcox Company. Microprocessors can also be utilized which are known in the art such as the system known as the NETWORK 90 control system which is a trademark of The Babcock & Wilcox Company, a subsidiary of McDermott Incorporated.

Referring to FIG. 2, control unit 12 receives as inputs sensed values for suction and discharge pressures over transmitters 14 and 16, and suction and discharge temperatures over transmitters 18 and 20. A division operation of the values received are conducted by suitably provided value dividers 22, 24 and 26. In divider 26, the discharge pressure value is divided by the constant m. A calculating element 28 raises the divided value of discharge pressure over suction pressure by the constant m from which is subtracted a quantity of 1 in element 30. The multiplication element 32 multiplies the values received from elements 30, 22 and 26 which each other and with the constant K and outputs a calculated desired value for the discharge orifice differential pressure $h_d$ over line 34 to controller 36 which compares the calculated value to an actual value received over transmitter 38 to generate an error signal. The error signal is utilized to control a blow-off valve 40 which is connected in a recirculation line 42. Centrifugal compressor 44 having suction line 46 and discharge line 48 is thus controlled to maintain it at or above its surge line.

Figure 3:
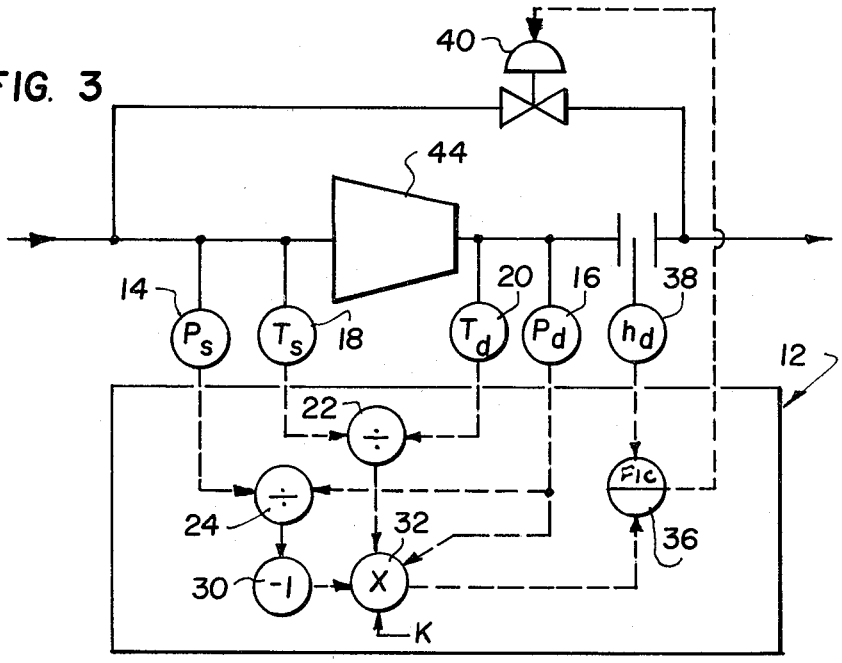
FIG. 3 is a view similar to FIG. 2 of another embodiment of the invention.
Figure 4:
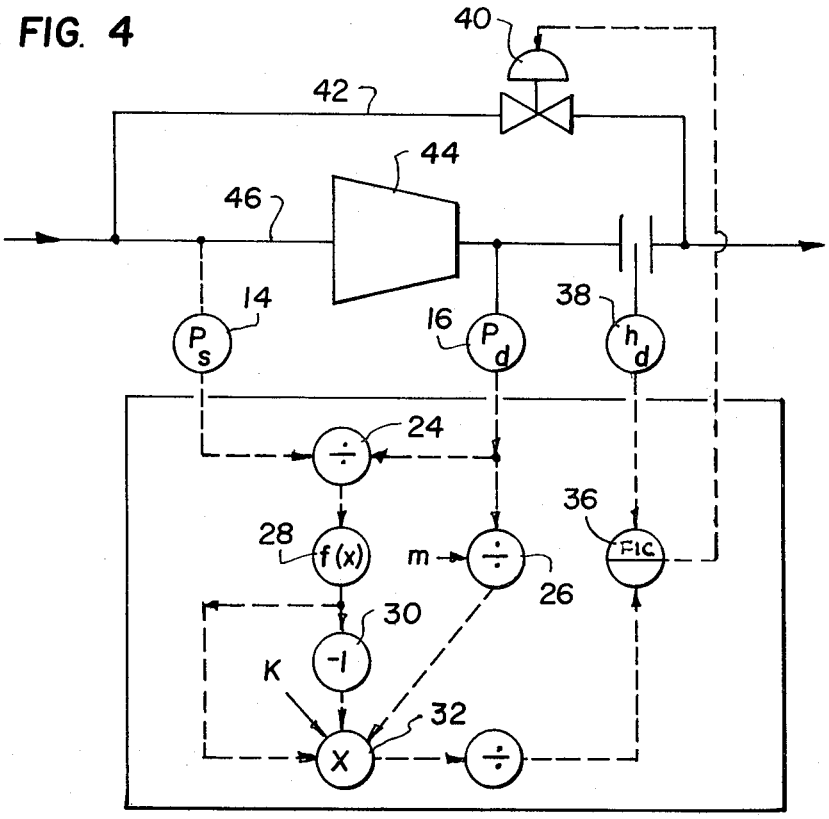
FIG. 4 is a schematic representation of a still further embodiment of the invention wherein only discharge and suction pressures are utilized.
Figure 5:
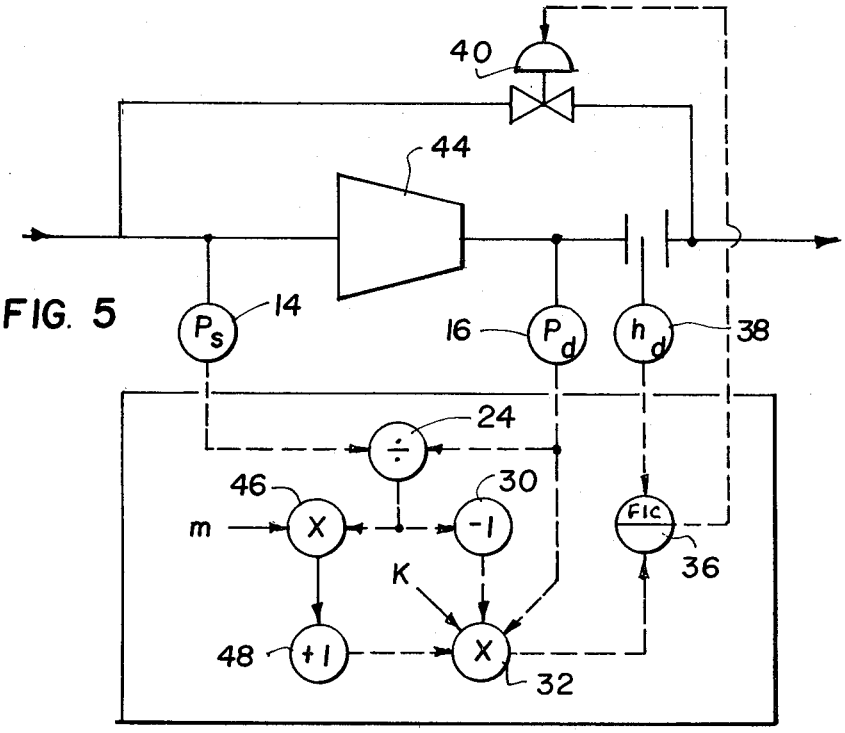
FIG. 5 is a view similar to FIG. 4 of another embodiment of the invention.

In the embodiments shown in FIGS. 3 through 5, similar numerals are utilized to designate the same or similar elements. The instrumention of FIG. 3 operates to calculate the discharge orifice differential pressure according to equation (11a).

The embodiment of FIG. 4 shows the implementation of equation (13). It is noted that in this embodiment the suction and discharge temperature value are unnecesary. It is also noted that when the constant m equals 1, the division element 26 can be eliminated to further simplify the system.

In FIG. 5, an implementation of equation (13a) is shown. Here, two additional elements are utilized, element 46 which multiplies the value received from element 24 by the constant factor m and element 48 which adds 1 to the value received from element 46.

The system described above is applicable to compressors which are run at variable speed. One common type of compressor is run at fixed speed where the inlet guide veins are adjusted to change the head flow characteristics. This does not alter the method of approximation for the surge control line, however, since the basic equations presented above do not change.

The apparatus and method according to the invention represents the most accurate full-range surge control which is practical.

The surge control system, according to the invention, is a protective device and, as such, is not adjusted as a plant operation variable.

It is also noted that while a number of variables are taken into account, such as the suction and discharge pressures, in actual practice, additional simplifications take place where one or more of the variables are held constant.

For example, suction temperature $T_s$ may be constant to upstream process control. Discharge temperature $T_d$ may be constant due to downstream process control. Suction pressure Ps may be constant to upstream pressure control or discharge pressure $P_d$ may be constant due to upstream pressure control or because compressor speed is adjusted to hold it constant. In such cases, a constant may be used in the equation, thus reducing the number of transmitters required and also the calculating elements in the control unit.

In general, the device and method for implementation of equations 11a and 13a are more applicable for compressors with low compression ratios and the implementation of equations (11) and (13) are applicable for compressors having higher compression ratios.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

What is claimed is:

1. A method of controlling a centrifugal compressor having a suction side and a discharge side with a recirculation line connected between the suction and discharge sides having a valve therein comprising:

sensing a suction side pressure of the compressor to obtain a value thereof;

sensing a discharge side pressure of the compressor to obtain a value thereof;

sensing discharge side orifice differential pressure of the compressor to obtain an actual value thereof;

calculating a desired orifice differential pressure using a formula which is a function of the suction side and discharge side pressures;

comparing the actual and desired differential pressure values to obtain an error signal; and adjusting the valve to reduce the error signal to zero and thereby cause the actual differential pressure to substantially equal the desired differential pressure.

2. A method according to claim 1, including sensing a suction side temperature of the compressor to obtain a value thereof;

sensing a discharge side temperature of the compressor to obtain a value thereof and wherein the formula is:

$$h_d = K\left(\frac{T_s}{T_d}\right)\left(\frac{P_d}{m}\right)\left[\left(\frac{P_d}{P_s}\right)^m - 1\right]$$

wherein:

$h_d$=the discharge orifice differential pressure;

K=is a constant;

$T_s$=the suction side temperature, $T_d$=the discharge side temperature, $P_d$=the discharge side pressure, $P_s$=the suction side pressure, and m=one minus the specific heat of a gas compressed by the compressor at constant volume divided by the specific heat of the gas at constant pressure.

3. A method according to claim 2, wherein the value of m is selected to equal one, the compressor being of the type which has a relatively low compression ratio.

4. A method according to claim 1, wherein the formula is:

$$h_d = K\left(\frac{P_d}{m}\right)\left(\frac{P_d}{P_s}\right)^m\left[\left(\frac{P_d}{P_s}\right)^m - 1\right]$$

wherein:

$h_d$=the discharge orifice differential pressure;

K=is a constant;

$P_s$=the suction side pressure, and $P_d$=the discharge side pressure, and m=one minus the specific heat of a gas compressed by the compressor at constant volume divided by the specific heat of the gas at constant pressure.

5. A method according to claim 1, wherein the formula is:

$$h_d = K(P_d)\left(\frac{P_d}{P_s} - 1\right)\left[1 + m\left(\frac{P_d}{P_s}\right)\right]$$

wherein:

$h_d$=the discharge orifice differential pressure;

K=is a constant;

$P_s$=the suction side pressure, $P_d$=the discharge side pressure, and m=one minus the specific heat of a gas compressed by the compressor at constant volume divided by the specific heat of the gas at constant pressure.

6. An apparatus for controlling a centrifugal compressor comprising:

a suction line connected to an input of the compressor;

a discharge side line connected to an output of the compressor;

a recirculation line connected between the discharge side and the suction side lines;

a pressure control valve in said recirculation line;

a controller connected to said valve for controlling said valve;

a suction side pressure transmitter for transmitting a suction side pressure value (Ps);

a discharge side pressure transmitter for transmitting a discharge side pressure value (Pd);

an orifice differential pressure transmitter for transmitting an orifice differential pressure from the discharge side (hd) of the compressor;

a control unit connected to said suction and discharge side pressure transmitters and to said controller for calculating a desired value for the orifice differential pressure; and said controller determining a difference between the actual and calculated differential orifice pressures and using the difference to control said pressure control valve to change the actual differential orifice pressure value to meet the calculated differential pressure value.

7. A device according to claim 6, wherein said control unit calculates the desired differential pressure according to the formula:

$$h_d = K\left(\frac{P_d}{m}\right)\left(\frac{P_d}{P_s}\right)^m\left[\left(\frac{P_d}{P_s}\right)^m - 1\right]$$

wherein:

$h_d$=discharge orifice differential pressure;

K=is a constant;

$P_s$=the suction side pressure, and $P_d$=the discharge side pressure, and m=one minus the specific heat of a gas compressed by the compressor at constant volume divided by the specific heat of the gas at constant pressure.

8. A device according to claim 6, wherein said control unit calculates the desired differential pressure according to the formula:

$$h_d = K(P_d)\left(\frac{P_d}{P_s} - 1\right)\left[1 + M\left(\frac{P_d}{P_s}\right)\right]$$

wherein:

$h_d$=the discharge orifice differential pressure;

K=is a constant;

$P_s$=the suction side pressure;

$P_d$=the discharge side pressure, and m=one minus the specific heat of a gas compressed by the compressor at constant volume divided by the specific heat of the gas at constant pressure.

9. A device according to claim 6, including a suction side and discharge side temperature transmitter for transmitting the suction side and discharge side temperatures to said control unit, said control unit calculating the desired differential pressure according to the formula:

$$h_d = K\left(\frac{T_s}{T_d}\right)\left(\frac{P_d}{m}\right)\left[\left(\frac{P_d}{P_s}\right)^m - 1\right]$$

wherein:

$h_d$=the discharge orifice differential pressure;
K=is a constant;
$T_s$=the suction side temperature,
$T_d$=the discharge side temperature,
$P_d$=the discharge side pressure,
$P_s$=the suction side pressure, and
m=one minus the specific heat of a gas compressed by the compressor at constant volume divided by the specific heat of the gas at constant pressure.

* * * * *